US006371588B1

(12) United States Patent
Tsuruoka

(10) Patent No.: US 6,371,588 B1
(45) Date of Patent: Apr. 16, 2002

(54) PRINTHEAD AND PRINTING APPARATUS USING PRINTHEAD

(75) Inventor: Yuji Tsuruoka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/466,179

(22) Filed: Dec. 17, 1999

(30) Foreign Application Priority Data

Dec. 21, 1998 (JP) ..... 10-363525

(51) Int. Cl.[7] ..... B41J 29/38; B41J 29/393; B41J 2/21

(52) U.S. Cl. ..... 347/12; 347/19; 347/43

(58) Field of Search ..... 347/12, 13, 180, 347/181, 182, 19, 43, 40

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,049,898 A | | 9/1991 | Arthur et al. | 347/19 |
| 5,873,661 A | * | 2/1999 | Mwrata et al. | 400/124.04 |
| 5,933,161 A | * | 8/1999 | Sato et al. | 347/12 |

FOREIGN PATENT DOCUMENTS

| | | |
|---|---|---|
| EP | 938976 | 9/1999 |
| EP | 948188 | 10/1999 |
| JP | 54-56847 | 5/1979 |
| JP | 56-89973 | 7/1981 |
| JP | 59-123670 | 7/1984 |
| JP | 60-71260 | 4/1985 |
| JP | 59-138461 | 8/1994 |
| JP | 9-104113 | 4/1997 |
| JP | 9-169112 | 6/1997 |
| JP | 9-254368 | 9/1997 |

OTHER PUBLICATIONS

09/216,715, "printingHead, printing apparatus and printing method", Tsuruoka Dec. 21, 1998 pending.

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

A printhead which high-precisely performs registration adjustment between print dots even in use of plural printheads or a printhead having plural printing element arrays, and a printing apparatus using the printhead. Registration adjustment can be performed with a value equal to or less than a printing resolution in a main-scanning direction by changing the order of nozzle blocks of at least one of two nozzle arrays, in accordance with a stored amount of registration shift, without transmission of a specific control signal from the printing apparatus.

15 Claims, 13 Drawing Sheets

FIG. 7

| BENB0,1 | BLK0,1 | | |
|---|---|---|---|
| | AMOUNT OF REGISTRATION SHIFT | | |
| | ±0 | ±1/4 | ±1/2 |
| 0 | 0 | 3 | 2 |
| 1 | 1 | 0 | 3 |
| 2 | 2 | 1 | 0 |
| 3 | 3 | 2 | 1 |

PRINTHEAD AND PRINTING APPARATUS USING PRINTHEAD

BACKGROUND OF THE INVENTION

This invention relates to a printhead and a printing apparatus using the printhead, and more particularly, to a printhead which performs printing in accordance with an ink-jet method and a printing apparatus using the printhead.

Recently, ink-jet printers capable of color printing are widely used. In these printers, it is necessary to discharge a plurality of color ink such as yellow ink, magenta ink and cyan ink, as well as black ink, to a printing medium. For this purpose, an increasing number of printers have a plurality of printheads on a carriage. The printheads are arrayed in a moving direction of the carriage (main-scanning direction). Otherwise, a number of printers have an integrated type printhead where a plurality of arrays of ink discharge nozzles, corresponding to the respective ink colors, are arranged in the main-scanning direction, as one printhead.

On the other hand, in any construction of printhead or arrangement of nozzle arrays as above, to realize high precision color printing, the most important problem is how precisely dots of respective color ink are overlaid on a printing medium.

Regarding such registration adjustment, in the printers with a plurality of printheads, it is almost impossible to mechanically precisely adjust registration of respective color ink dots. Generally, these printers are constructed such that the driving timing for each printhead can be freely changed. For example, electrical adjustment means is provided to shift a dot position at ± several 10-dot pitch in the main-scanning direction. Prior to actual printing, a registration adjustment pattern is printed on a printing medium, then a user judges the amount of registration shift by visual measurement and adjusts the registration.

However, in conventional ordinary low-price color printers, it is almost impossible to provide a head driving signal in each of the printheads because such arrangement increases complexity of the system and the price, from the following reasons:

(1) The number of signal lines in the printheads increases.

(2) The driving timing circuits, corresponding to the number of printheads, must be provided.

Generally, a signal (signal line) other than a print data transmission signal is provided for common use among the printheads. In these printers, as all the printheads are driven with the same head driving timing, registration adjustment is simply performed in 1-dot pitch units but registration shift at the maximum ½ dot pitch cannot be solved.

On the other hand, in the integrated type printhead having plural nozzle arrays, the maximum level of registration adjustment is about several 10 $\mu$m in manufacturing. However, in a printhead having a printing resolution of 600 dpi, the above shift amount is intolerable since the dot pitch of this printhead is about 42 $\mu$m.

SUMMARY OF THE INVENTION

Accordingly, it is an object of the present invention to provide a printhead which performs high-precision registration adjustment on print dots even in use of plural printheads or a printhead having plural printing element arrays and a printing apparatus using the printhead.

According to one aspect of the present invention, the foregoing object is attained by providing a printhead capable of printing by dividing a plurality of printing elements constituting a printing element array into a plurality of blocks and time-divisionally driving the plurality of printing elements in block units, comprising: a memory circuit for storing a value based on an amount of registration shift equal to or less than a printing resolution in a direction in which the printing element array is scanned relative to a printing medium; and a changing circuit that changes an order of blocks to be driven in accordance with the value stored in the memory circuit.

It is preferable that a number of the printing element array is two or more, the plurality of printing element arrays (e.g. a first and second printing element arrays) are arranged at an interval along the scanning direction of the printing element arrays, and the changing circuit changes the order of blocks to be driven in at least one of the plurality of printing element arrays.

Note that division of the plurality of printing elements into blocks may be made by dividing the plurality of printing elements of the first and second printing element arrays into blocks by N printing elements sequentially, or by dividing the plurality of printing elements of the first and second printing element arrays into blocks by K printing elements each selected from every M printing elements. For example, the plurality of printing elements are divided into four, eight, sixteen or thirty two blocks.

It is preferable that the direction of the plurality of printing elements of the first and second printing element arrays is diagonal to the scanning direction.

Further, it is preferable that the printhead further comprises a delay circuit that delays print data output to printing elements of each block of the printing element array, in accordance with change of the order of blocks to be driven by the changing circuit.

Note that it is preferable that the printhead is an ink-jet printhead that performs printing by discharging ink. Further, the ink-jet printhead has electrothermal transducers for generating thermal energy to be supplied to ink, for discharging the ink by utilizing the thermal energy.

It is preferable that such printhead further comprises third and fourth printing element arrays in the first direction in parallel to the first and second printing element arrays, and color printing is performed by discharging yellow ink, magenta ink, cyan ink and black ink from the first, second, third and fourth printing element arrays.

Further, it may be arranged such that the first and second printing element arrays are respectively assembled in separate printheads.

According to another aspect of the present invention, the foregoing object is attained by providing a printing apparatus which performs printing by using the printhead having the above construction, comprising: scanning means, carrying the printhead, for reciprocate-scanning the printhead along the scanning direction; and output means for outputting print data to the printhead.

According to still another aspect of the present invention, the foregoing object is attained by providing a printing apparatus which performs printing by dividing a plurality of printing elements constituting a printing element array into a plurality of blocks and time-divisionally driving the plurality of printing elements in block units, comprising: a memory circuit for storing a value based on an amount of registration shift equal to or less than a printing resolution in a direction in which the printing element array is scanned relative to a printing medium; and a changing circuit that changes an order of blocks to be driven in accordance with the value stored in the memory circuit.

Note that it may be arranged such that the printing apparatus further comprises a delay circuit that delays print data output to printing elements of each block of the printing element array, in accordance with change of the order of blocks to be driven by the changing circuit.

In accordance with the present invention as described above, registration adjustment can be performed with the value equal to or less than the printing resolution in the direction in which the printing element array is scanned relative to a printing medium without transmitting a specific control signal from the printing apparatus, by changing the order of blocks to be driven within the printing element array in accordance with a value based on the amount of registration shift stored in a memory circuit.

The invention is particularly advantageous since almost all the registration shift can be solved.

Accordingly, high quality images can be printed.

Especially, in case of a printhead having a plurality of printing element arrays, the precision of registration adjustment in manufacturing can be relaxed. Further, as the registration adjustment can be completed within the printhead, a registration adjustment function is unnecessary on the printing apparatus side holding the printhead. This contributes to simplification of the apparatus construction.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 is a conversion table used for converting block driving signals (BENB0,1) into block selection signals (BLK0,1) according to registration shift amounts;

DETAILED DESCRIPTION OF THE PREFERRED EMBODIMENTS

Preferred embodiments of the present invention will now be described in detail in accordance with the accompanying drawings.

<Outline of Apparatus Main Body>

Figure 1:
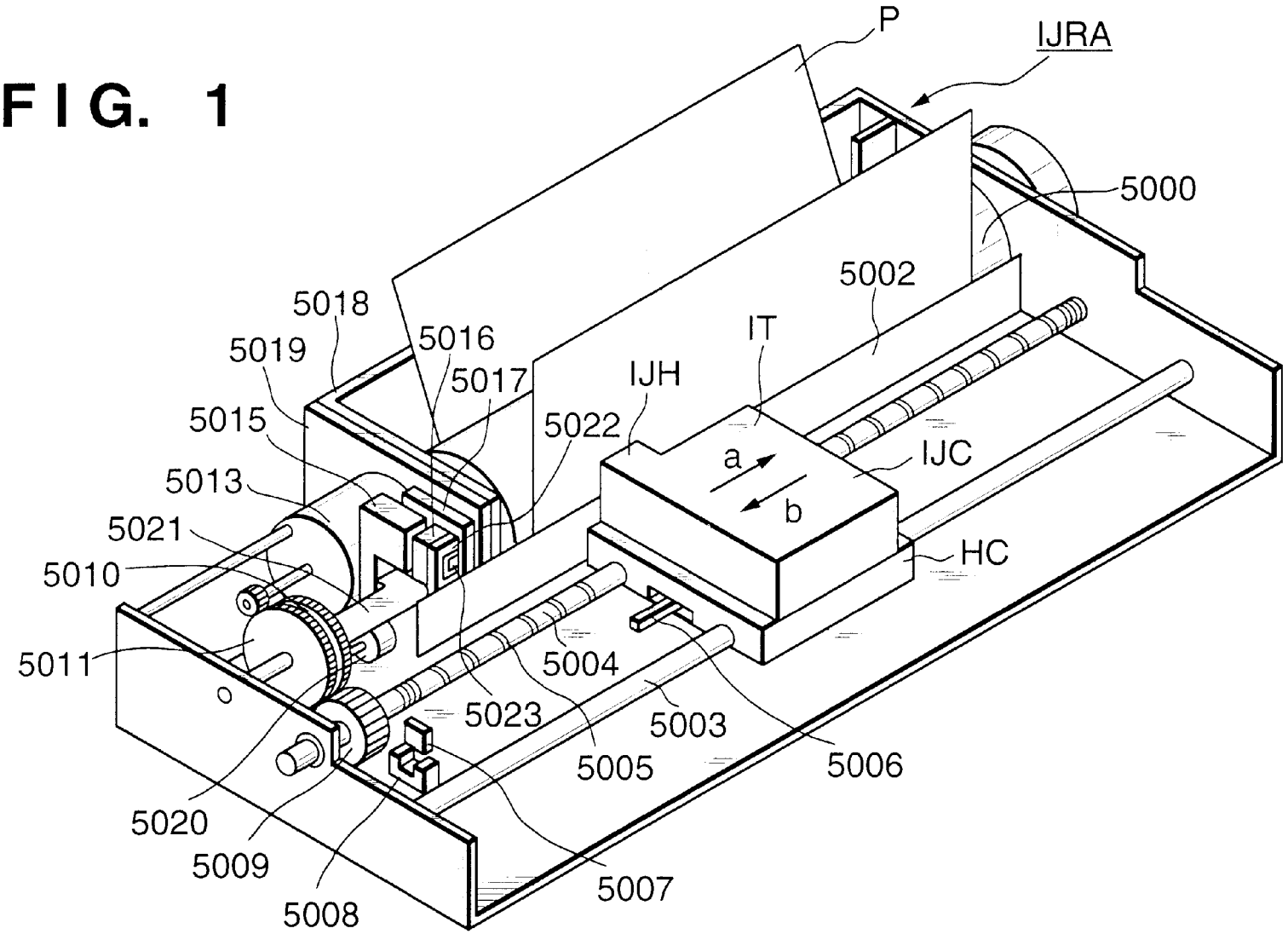
FIG. 1 is a perspective view showing the schematic structure of an ink-jet printer IJRA as a typical embodiment of the present invention.

FIG. 1 is a perspective view showing the structure of an ink-jet printer IJRA as a typical embodiment of the present invention. In FIG. 1, a carriage HC is engaged with a spiral groove 5004 of a lead screw 5005 which rotates via drive force transmission gears 5009 to 5011 interlocking with forward/reverse rotation of a driving motor 5013. The carriage HC has a pin (not shown) and it reciprocates in directions represented by arrows a and b, held by a guide rail 5003. The carriage HC has an ink-jet cartridge IJC which integrally comprises a printhead IJH and an ink tank IT. A paper holding plate 5002 presses a print sheet P against a platen 5000 along the moving direction of the carriage HC. Photocouplers 5007 and 5008 are home position detecting members for confirming the existence of lever 5006 of the carriage in this area and changing over the rotational direction of motor 5013. A support member 5016 supports a cap member 5022 for capping the front surface of the printhead IJH. A suction member 5015 performs suction-restoration of the printhead by sucking the inside of the cap member 5022 via a cap inner opening 5023. Member 5019 allows a cleaning blade 5017 to move in a back-and-forth direction. A main body support plate 5018 supports the member 5019 and the cleaning blade 5017. It is apparent that any well-known cleaning blade is applicable to the printer of the embodiments. Numeral 5021 denotes a lever for starting the sucking operation of the suction-restoration. The lever 5021 moves along the movement of a cam 5020 engaged with the carriage HC. A well-known transmission mechanism such as change-over of a clutch controls a drive force from the driving motor.

When the carriage HC is at the home position area, a desired one of these capping, cleaning and suction-restoration is executed at its corresponding position by the lead screw 5005. The timing of any of these processings is not limited to the printer of the embodiments, if a desired processing is performed at a well-known timing.

<Control Construction >

Next, the control construction for execution of print-control by the above printing apparatus will be described.

Figure 2:
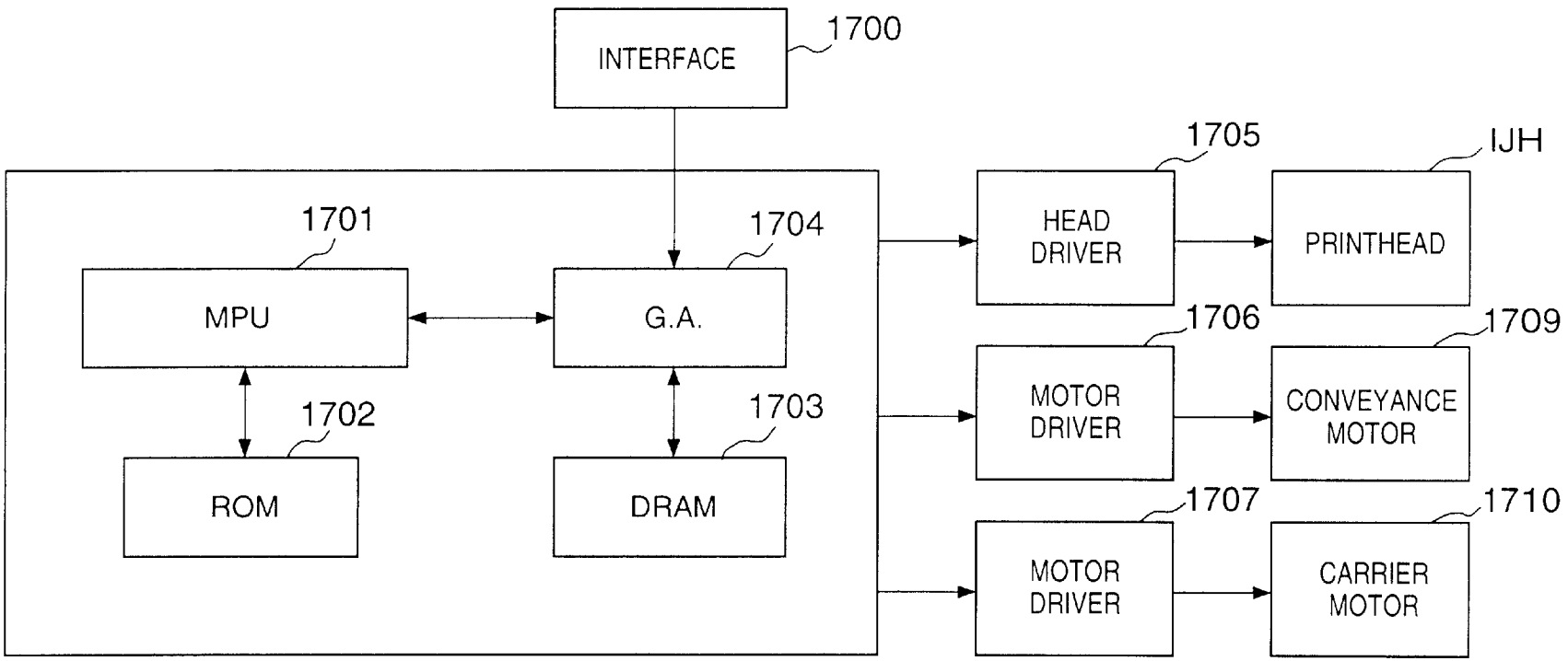
FIG. 2 is a block diagram showing the construction of a control circuit of the ink-jet printer IJRA.

FIG. 2 is a block diagram showing the construction of a control circuit of the ink-jet printer IJRA. Referring to FIG. 2 showing the control circuit, reference numeral 1700 denotes an interface for inputting a print signal; 1701, an MPU; 1702, a ROM for storing a control program executed by the MPU 1701; and 1703, a DRAM for storing various data (the print signal, print data supplied to the printhead and the like). Numeral 1704 denotes a gate array (G. A.) for performing supply control of print data to the printhead IJH. The gate array 1704 also performs data-transfer control among the interface 1700, the MPU 1701, and the RAM 1703. Numeral 1710 denotes a carrier motor for transferring the printhead IJH; 1709, a conveyance motor for conveying the print sheet P; 1705, a head driver for driving the printhead IJH; and 1706 and 1707, motor drivers for driving the conveyance motor 1709 and the carrier motor 1710.

The operation of the above control arrangement will be described below. When a print signal is inputted into the interface 1700, the print signal is converted into print data for a printing operation between the gate array 1704 and the MPU 1701. The motor drivers 1706 and 1707 are driven, and the printhead IJH is driven in accordance with the print data supplied to the head driver 1705, thus performing the printing operation.

Note that as described above, the ink tank IT and the printhead IJH may be integrally formed as an exchangeable ink cartridge IJC. Further, it may be arranged such that the ink tank IT and the printhead IJH can be separated, and when ink is exhausted, only the ink tank IT is exchanged for new one.

Figure 3:
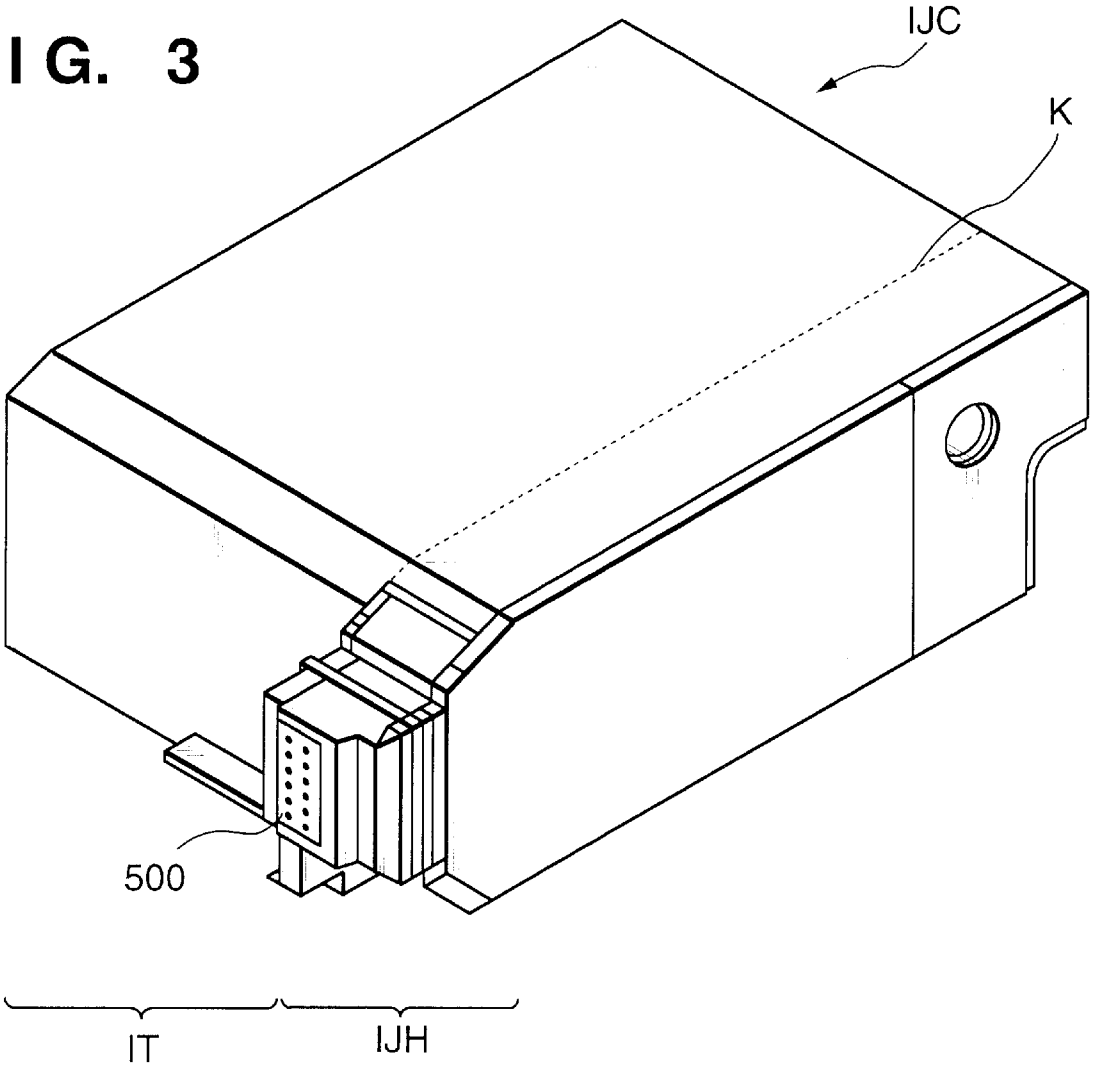
FIG. 3 is a perspective view of an ink cartridge IJC where an ink tank and a head can be separated.

FIG. 3 is a perspective view showing the structure of the ink cartridge IJC in which the ink tank and the head can be separated. As shown in FIG. 3, in the ink cartridge IJC, the ink tank IT and the printhead IJH can be separated along a line K. The ink cartridge IJH has an electrode (not shown) to receive an electric signal supplied from the carriage HC side when the ink cartridge IJC is mounted on the carriage HC. In accordance with the electric signal, the printhead IJH is driven as described above, to discharge ink.

Note that in FIG. 3, numeral 500 denotes an array of ink discharge orifices (an array of print elements) in which ink discharge ports (nozzles) constituting print elements are arranged. Further note that the number of ink discharge nozzles shown in FIG. 3 is reduced for the sake of simplicity for explanation. Furthermore, the ink tank IT has a fiber or porous ink absorber to hold ink.

The print elements comprises ink discharge ports (nozzles), ink channels connecting to the ink discharge ports respectively and heaters provided in ink channels respectively.

Figure 4:
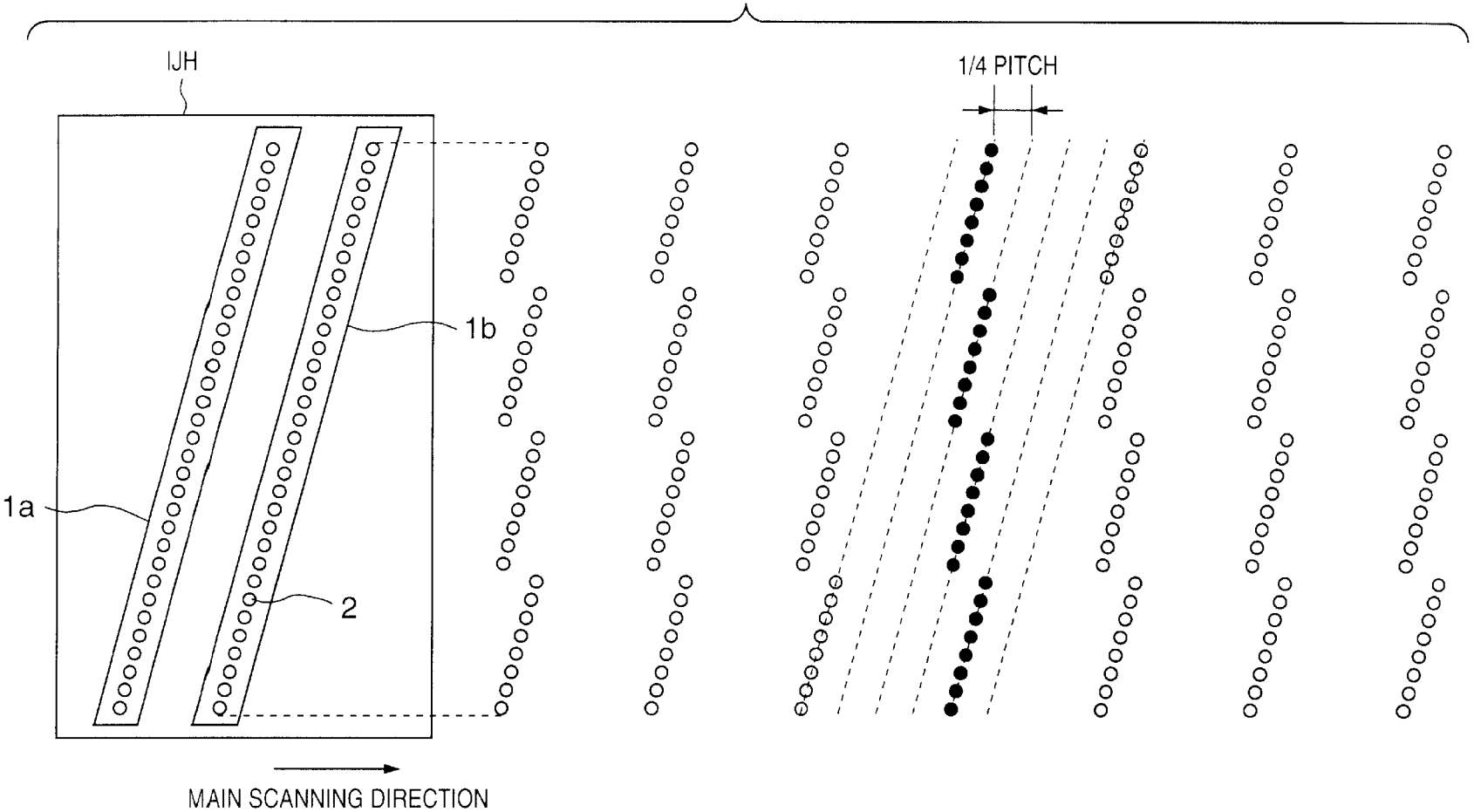
FIG. 4 is an explanatory diagram of a printhead IJH viewed from the side of ink discharge surface.

FIG. 4 is an explanatory diagram of a printhead IJH viewed from the side of ink discharge surface.

As shown in FIG. 4, the printhead IJH has two arrays of ink discharge nozzles (hereinafter referred to as "nozzle arrays") provided at a certain interval along a main-scanning direction in which the carriage HC moves. These two nozzle arrays 1*a* and 1*b* respectively have 32 nozzles 2. The 32 nozzles are divided, by continuous 8 nozzles, into 4 blocks, each block being concurrently driven, and upon execution of printing operation, driven at shifted driving timing for each block.

In a case where ink discharge is performed while moving the printhead IJH in the main-scanning direction, if the nozzle arrays are provided vertical to the main-scanning direction, the arrangements of dots printed by each block of continuous 8 nozzles are shifted away from each other. As a result, the arrangement of all printed dots looks considerably slant as a whole. Accordingly, the nozzle arrays are provided diagonally to the main-scanning direction in advance such that the dot arrangement of all print dots are substantially vertical to the main-scanning direction.

However, since the nozzle arrays are divided into 4 blocks and driven in block units, the amount of dot shift in each junction between nozzle blocks is ¼ of the dot pitch in the main-scanning direction as shown in an example in FIG. 4.

Note that in recent high precision printers, the ¼ pitch shift is intolerable for maintaining high print image quality. Generally, in such printers, the number of nozzle blocks is "8" or "16". However, in this embodiment, the number of nozzle blocks is "4" for the sake of simplicity of explanation.

Figure 5:
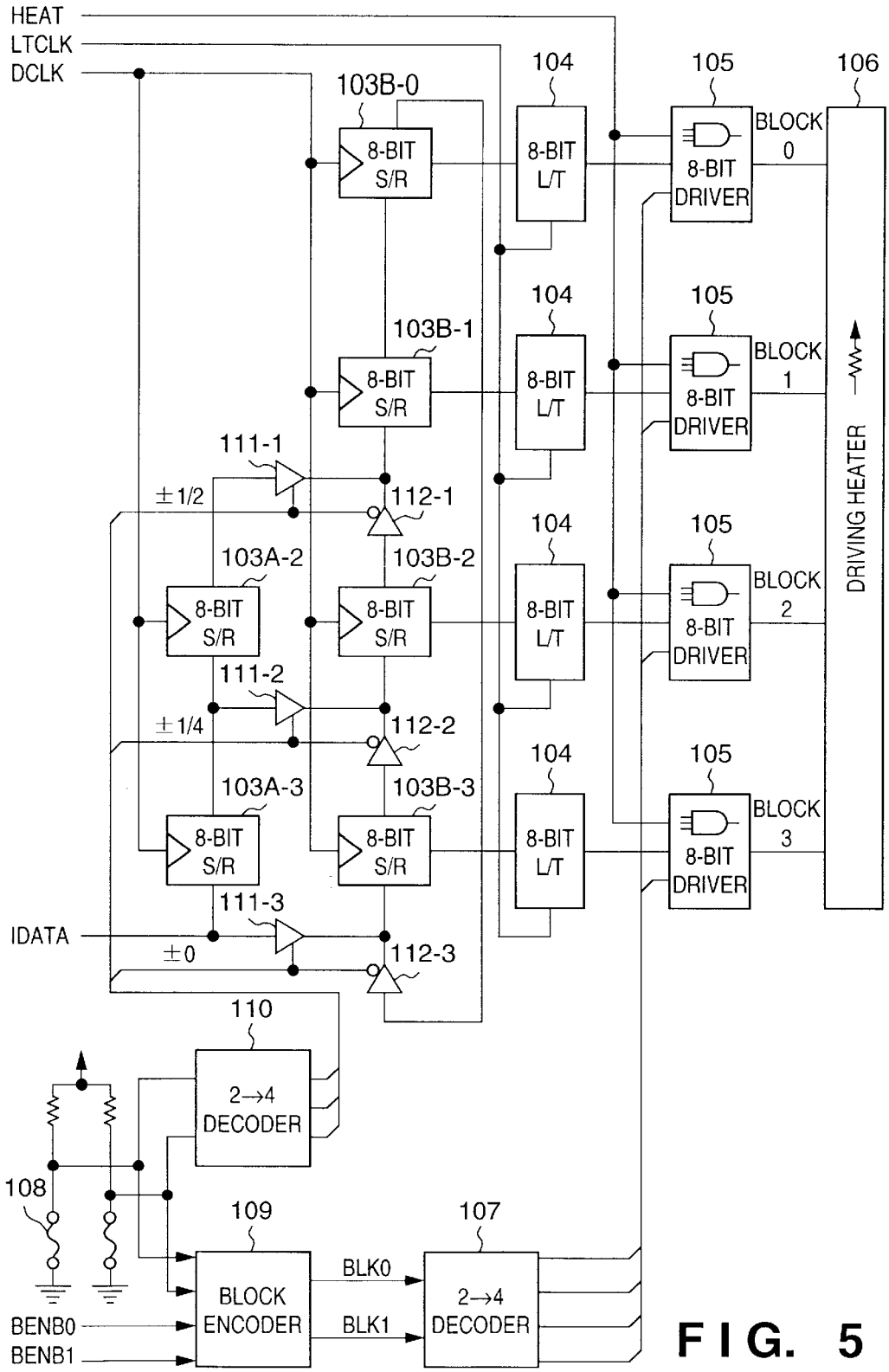
FIG. 5 is a block diagram showing the construction of a logic circuit of the printhead IJH.

FIG. 5 is a block diagram showing the construction of a logic circuit of the printhead IJH according to the present invention.

Note that for the sake of simplicity of explanation, FIG. 5 shows the construction of a circuit to drive one of the two nozzle arrays shown in FIG. 4. The printhead IJH actually has two driving circuits.

Figure 6:
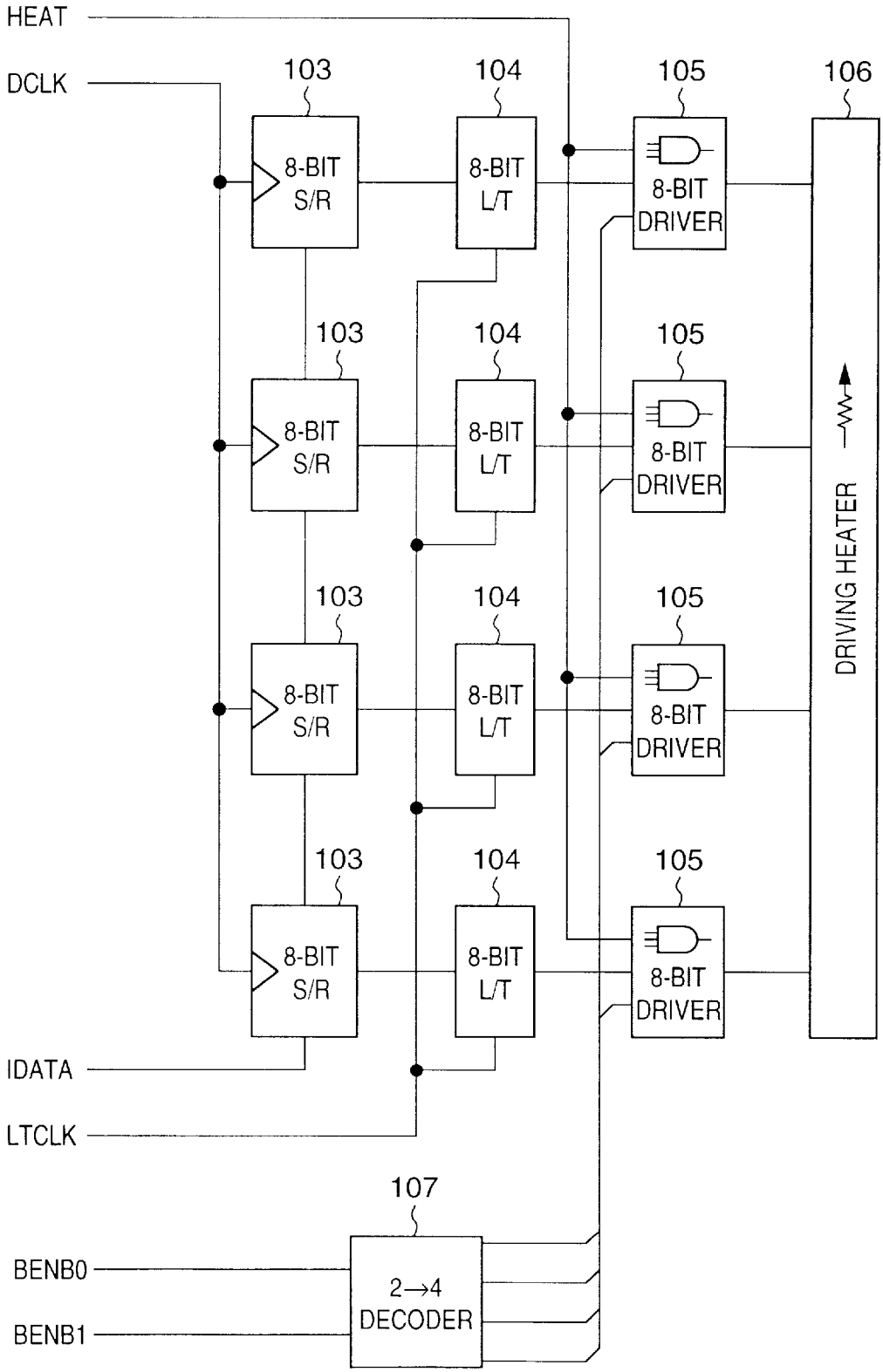
FIG. 6 is a block diagram showing the construction of a logic circuit of a conventional printhead.

On the other hand, FIG. 6 is a block diagram showing the construction of a logic circuit of a conventional printhead. In this example, the printhead has 32 ink discharge nozzles as in the case of the printhead IJH. The nozzles are divided into 4 block each having 8 nozzles, and time-divisionally driven. Accordingly, in FIG. 6, constituent elements and signals corresponding to those in FIG. 5 have the same reference numerals and symbols.

The printheads in FIGS. 5 and 6 basically operate as follows.

That is, a print data signal (IDATA) is serially transferred to four serially-connected 8-bit shift registers (S/Rs) 103 in synchronization with a transfer clock (DCLK), then, the print data signals stored in the shift registers are latched by four 8-bit latch circuits (L/Ts) 104 in synchronization with a latch clock (LTCLK).

On the other hand, input block driving signals (BENB0,1) are decoded by a 2→4 decoder 107, and the order of blocks to be driven is determined by the block driving signals (BENB0,1). Then, signals outputted from the 2→4 decoder 107, indicative of the order of blocks to be driven, and an input driving signal (HEAT), and outputs from the four 8-bit latch circuits (104) are inputted into four 8-bit drivers 105, and the logical product (ANDs) among these signals are calculated. A heater 106 is driven based on the results of calculation by the 8-bit drivers 105.

However, in the logical circuit according to the present embodiment, in addition to the above basic operation, 0 to +½ dot registration can be shifted in the main-scanning direction regarding one nozzle array. Accordingly, the printhead IJH having 2 nozzle arrays perform registration adjustment within the range of relatively −½ to +½ bit pitch between the nozzle arrays 1*a* and 1*b*.

That is, the order of blocks to be driven is changed only in the nozzle array 1*b*, and the print data signal (IDATA) is shifted in accordance with the change of the order, thus registration correction is performed by unit of (dot pitch/number of nozzle blocks).

Hereinbelow, the registration correction will be described in detail.

First, a method for changing the order of blocks to be driven will be described.

In FIG. 5, a fuse 108 is employed for setting the amount of registration shift. As the printhead of the present embodiment performs 4-block time-division driving, to handle 2-bit data so as to represent 4 levels in correspondence with the number of blocks, two fuses are provided. The registration shift amounts between two nozzle arrays are measured in advance at a printhead manufacturing process, and in accordance with the measured values, values represented by 2 bits are set by cutting the fuses 108 by laser trimming.

As shown in FIG. 5, the signals representing the amounts of registration shift and the block driving signals (BENB0,1) are inputted into a block encoder 109, and in accordance with the relation as shown in the table of FIG. 7, converted into block selection signals (BLK0,1). Then, the block selection signals (BLK0,1) are inputted into the 2→4 decoder 107 and decoded there. Then the order of blocks to be driven is converted into the order as shown in FIG. 8.

FIG. 7 is a conversion table for the block selection signals (BLK0,1) corresponding to the block driving signals (BENB0,1). As shown in FIG. 7, the total 2 bits of the block driving signals (BENB0,1) represents four amounts (0 to 3), and from the relation with three amounts of registration shift ±0, ±¼ and ±½, the value of the 2-bit block selection signals (BLK0,1) is determined.

Figure 8A:
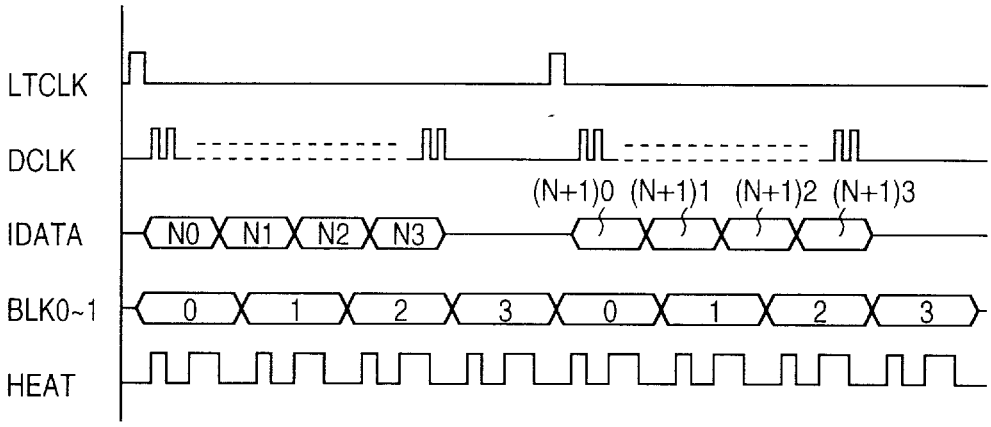
FIGS. 8A to 8C are timing charts showing various control signals handled in the printhead IJH.
Figure 8B:
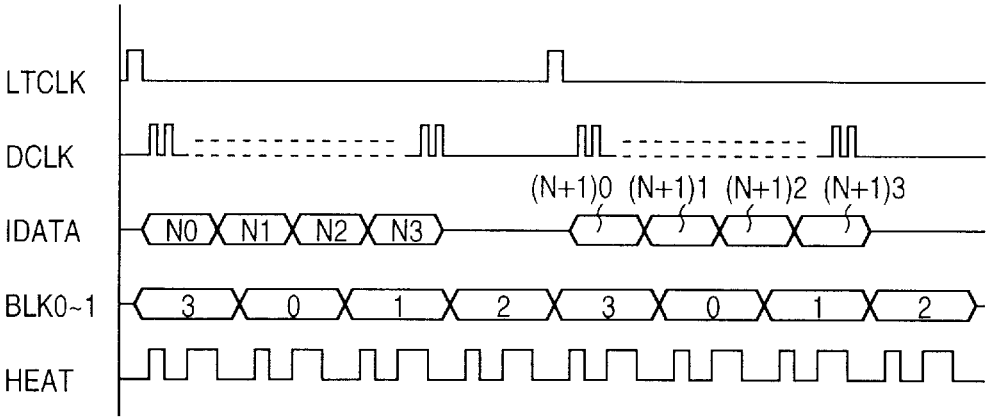
Figure 8C:
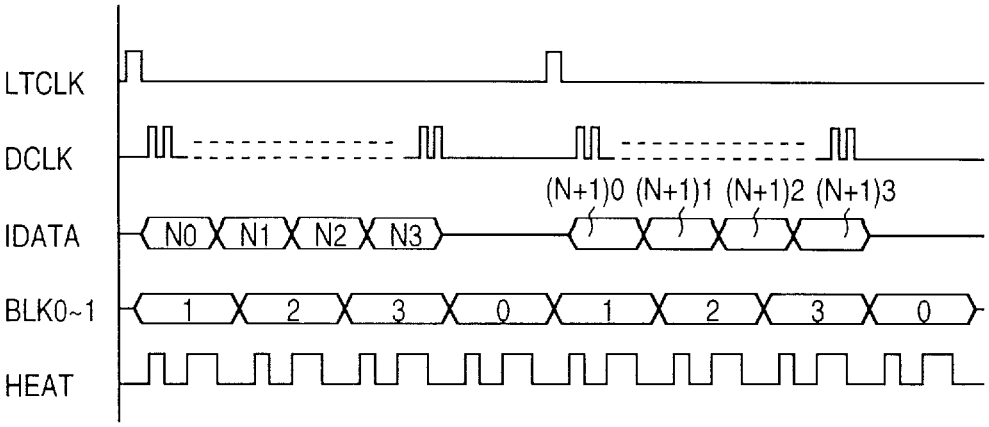

FIGS. 8A to 8C are timing charts showing various control signals handled in the printhead IJH.

FIG. 8A shows a normal order of blocks to be driven. That is, the value of the 2 bit block selection signals (BLK0,1) becomes "0"→"1"→"2"→"3" . . . in a cyclic manner, and in accordance with the change of the signal value, 32 heaters are sequentially driven in block units by 8 heaters. The block driving order is: block 0→block 1→block 2→block 3→ . . . However, as shown in FIGS. 8B and 8C, the order of the blocks to be driven is changed in accordance with the amount of registration shift, as represented by the value of the block selection signals (BLK0,1).

Next, a method for correcting the shift of print data signal (IDATA) upon registration shift correction will be described.

As shown in FIG. 7, the states of the fuses 108 are decoded by a 2→4 decoder 110 into signals indicative of three states, 0, ±¼ and ±½, in accordance with the amounts of registration shift, and inputted into tristate buffers 111-1 to 111-3 and 112-1 to 112-3 shown in FIG. 5.

If the registration shift=0 holds, since none of the fuses is cut off and the tristate buffer 111-3 is opened while the tristate buffer 112-3 is closed, the print data signal (IDATA) is directly inputted into the 8-bit shift register (S/R) 103B-3, and in accordance with the transfer clock (DCLK), shifted from the 8-bit shift register 103B-3 to the 8-bit shift register 103B-2, then to the 8-bit shift register 103B-1, and to the 8-bit shift register 103B-0. In this manner, as the shifted print data signal is directly inputted into the four 8-bit latch circuits (L/Ts) 104 in accordance with input of the latch clock (LTCLK), print data signals N0, N1, N2 and N3 of the same column are latched by the four 8-bit latch circuits (L/Ts) 104, as shown in FIG. 8A.

On the other hand, if the registration shift=±¼ holds, since one of the fuses 108 is cut off, a signal indicating the value (0,1) is outputted from the fuses 108 and the tristate buffer 111-2 is opened, while the tristate buffer 112-2 is closed, the print data signal (IDATA) is shifted from the 8-bit shift register 103A-3 to the 8-bit shift register 103B-2, then to the 8-bit shift register 103B-1, then to the 8-bit shift register 103B-0 and to the 8-bit shift register 103B-3.

In this case, since the 8-bit shift register 103A-3 is added as a data transfer path, the last data in one column data transfer supplied to the printhead is held in the 8-bit shift register 103A-3. Thus, the data is supplied to the 8-bit shift register 103B-3 by a data transfer clock of the subsequent column.

Accordingly, the output to the latch 104 from the shift registers is that print data signals N0, N1 and N2 of the same column are outputted from the 8-bit shift registers 103B-0 to 103B-2, but a print data signal (N−1)3 of a previous column is outputted from the 8-bit shift register 103B-3.

Similarly, if the registration shift=±½ holds, since the other of the fuses 108 is cut off, a signal indicating the value (1,0) is outputted from the fuses 108 and the tristate buffer 111-1 is opened, while the tristate buffer 112-1 is closed, the print data signals outputted from the four 8-bit shift registers to the latch 104 are N0 and N1 of the same column, and (N−1)2 and (N−1)3 of the previous column.

As described above, shift correction is also performed on the print data signals outputted from the shift registers in accordance with the registration shift.

Next, the registration shift correction performed by the apparatus having the above construction will be described with reference to the dot arrangements of actually printed dots in FIGS. 9A to 9C and FIGS. 10A to 10C.

Figure 9A:
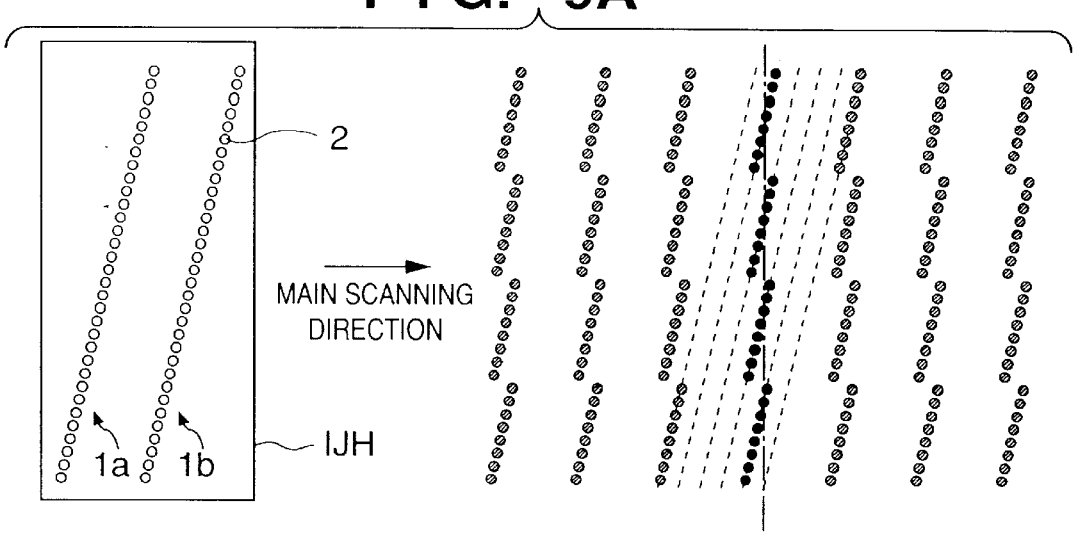
FIGS. 9A to 9C are explanatory diagrams showing dot arrangements in registration adjustment by shifting ink-droplet adhesion positions on a printing medium in a main-scanning direction.
Figure 9B:
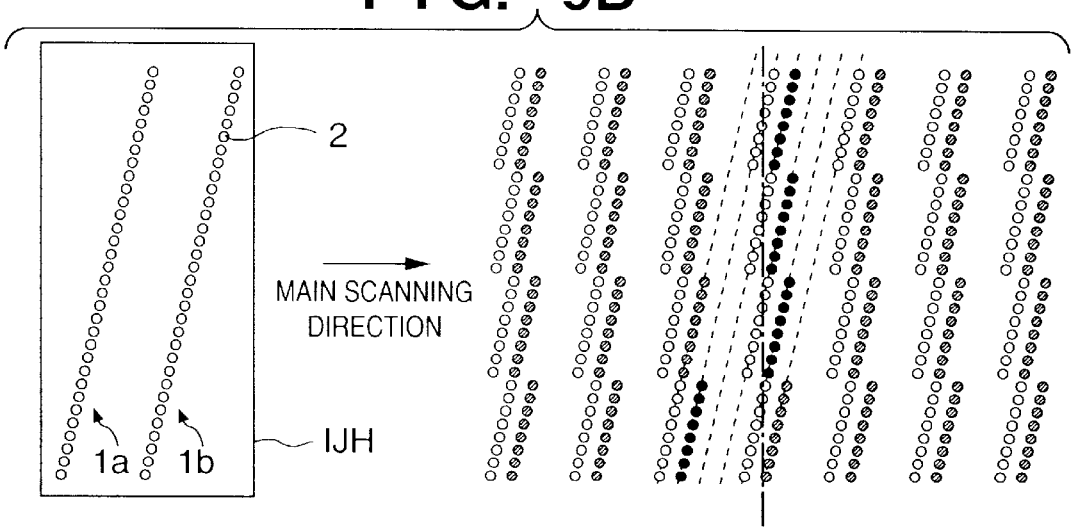
Figure 9C:
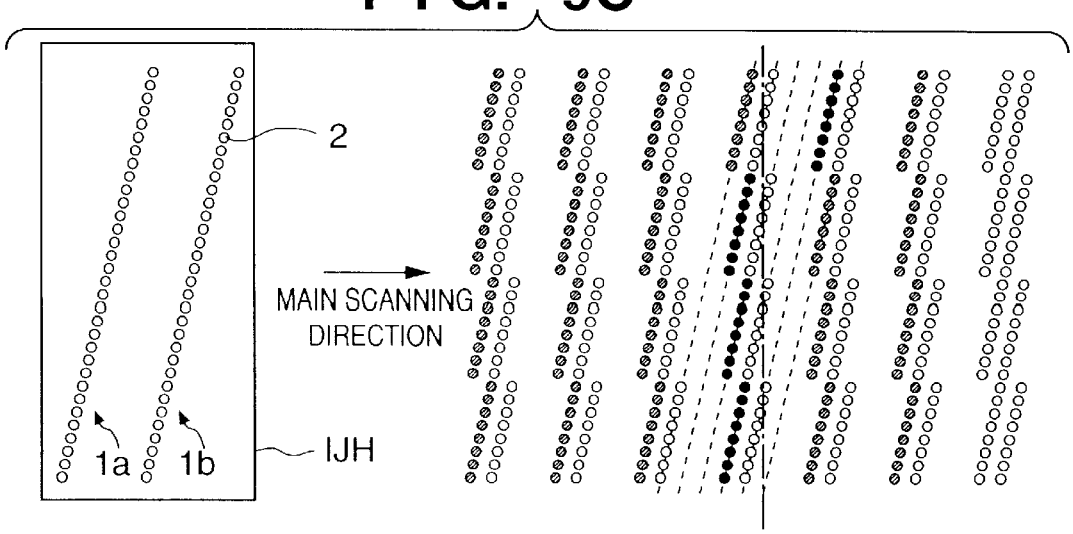

FIGS. 9A to 9C are explanatory diagrams showing dot arrangements in registration adjustment by shifting ink-droplet adhesion positions on a printing medium in the main-scanning direction.

Figure 10A:
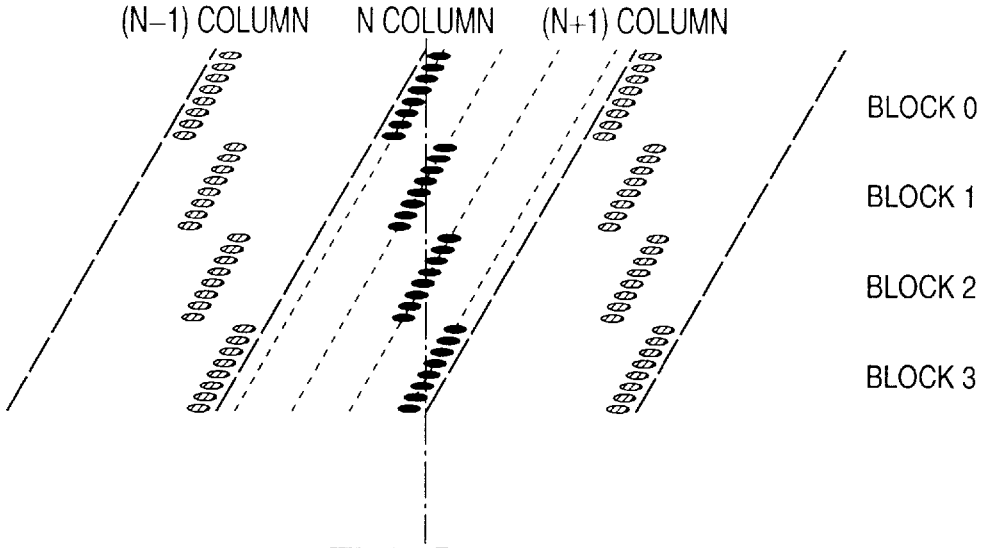
FIGS. 10A to 10C are partially-expanded diagrams of the dot arrangements in FIGS. 9A to 9C.
Figure 10B:
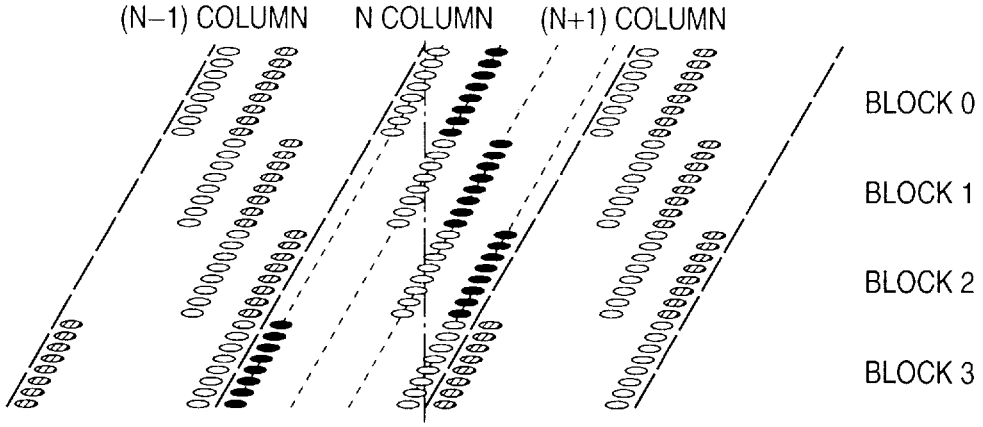
Figure 10C:
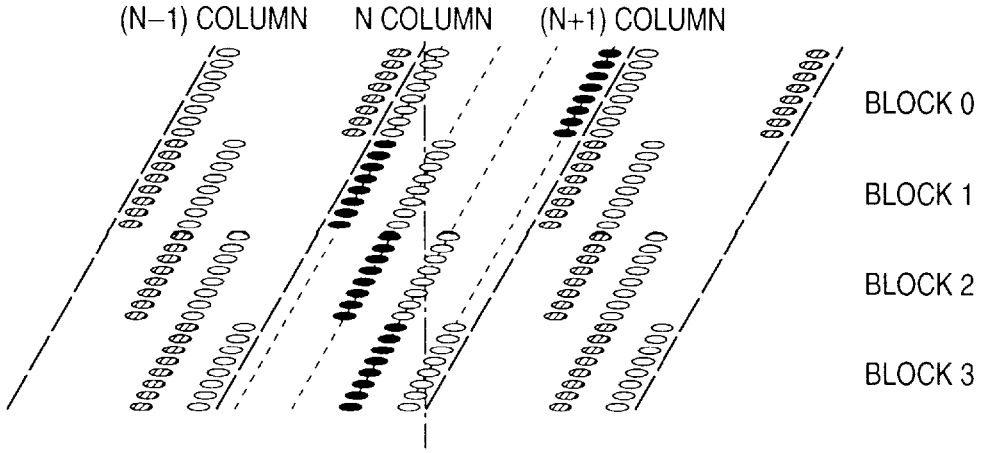

FIGS. 10A to 10C are partially-expanded diagrams of the dot arrangements in FIGS. 9A to 9C.

Note that as the printhead IJH uses a common signal to drive the heaters of nozzle arrays 1*a* and 1*b*, ink discharge from the respective nozzle arrays is always made at the same timing. For this reason, if the distance between dots of the two nozzle arrays in the main-scanning direction is an integral multiple of the dot pitch, dots printed with ink droplets discharged from the respective nozzles are precisely overlaid on the printing medium.

To simplify the explanation, in the present embodiment, it is assumed that the distance between dots printed with the ink discharged from the two nozzle arrays 1*a* and 1*b* is exactly m times (m is a positive integer) of the dot pitch. In FIGS. 9A to 9C and FIGS. 10A to 10C, a blank dot ○ represents a dot printed with ink from the nozzle array 1*a*; and a hatched dot ⊘ or black dot ●, a dot printed with ink from the nozzle array 1*b*.

FIGS. 9A to 9C and FIGS. 10A to 10C respectively show the dot arrangements of dots printed on a printing medium in a case where printing has been made with ink discharged from the nozzle array 1*b* and then ink is discharged from the nozzle array 1*a* moved by m dot pitch. The above-described FIGS. 8A to 8C are timing charts showing the corresponding timings of driving signal to cause ink discharge from the nozzle array 1*b*.

FIGS. 9A and 10A show a case where dots printed with ink discharged from the nozzle arrays 1*a* and 1*b* are overlaid precisely. In this case, the distance between the nozzle arrays 1*a* and 1*b* is an integral multiple (m times) of the dot pitch, and the order of blocks (BLK0-1) to be driven in the nozzle arrays 1*a* and that in 1*b* are the same.

That is, as shown in FIG. 8A, if the order of blocks is block 0→block 1→block 2→block 3, first, ink discharge is simultaneously performed by the 8 nozzles of the block 0, then the simultaneous ink discharge is sequentially performed by the respective 8 nozzles of the block 1→block 2→block 3, as shown in FIG. 10A.

FIGS. 9B and 10B show a dot arrangement when only the order of blocks in the nozzle array 1*b* is block 3→block 0→block 1→block 2, as shown in FIG. 8B. In this case, the positions of the dots printed by the nozzle array 1*a* are the same as those in FIGS. 9A and 10A since the order of blocks is the same as that in the above case. However, in ink discharge from the nozzle array 1*b*, as the block 3 is first driven, ink is discharged from the lowest block 3. Then the block 0→the block 1→the block 2 are sequentially driven to discharge ink. Accordingly, as shown in FIGS. 9B and 10B, the dots ● printed by the nozzle array 1*b* are shifted from the blank dots ○ printed by the nozzle array 1*a* by a +¼ dot pitch in the main-scanning direction.

FIGS. 9C and 10C show a dot arrangement when the order of blocks of the nozzle array 1*b* is block 1→block 2→block 3→block 0. In this case, ink discharge is first performed from the 8 nozzles of the block 1. Then the block 2→the block 3→the block 0 are sequentially driven to discharge ink. Accordingly, as shown in FIG. 10C, the dots printed by the nozzle array 1*b* are shifted from the dots printed by the nozzle array 1*a* by a −¼ dot pitch in the main-scanning direction.

Although FIG. 9B shows +¼ dot shift, however, if the order of blocks is block 2→block 3→block 0→block 1, the shift amount equals a +½ dot pitch; further, if the order of blocks is block 1→block 2→block 3→block 0, the shift amount equals a +¾ dot pitch.

Similarly, in FIG. 9C, if the order of blocks is block 2→block 3→block 0→block 1, the shift amount equals a −½ dot pitch; further, if the order of blocks is block 3→block 0→block 1→block 2, the shift amount equals a −¾ dot pitch.

Next, image shift which occurs in registration shift correction as described above will be described.

In FIG. 9A, as all the dots printed by the nozzle array 1*a* and all the dots printed by the nozzle array 1*b* are overlaid, an image in the same column is printed. That is, in FIG. 8A, data N0 to N3 of the print data signal (IDATA) are printed by the respective 8 nozzles corresponding to the blocks 0 to 3. In FIG. 9B, the dots printed by the nozzle array 1*a* are based on the print data signal of the same column (N), however, regarding the dots printed by the nozzle array 1*b*, data N0 to N2 of the print data signal used in the blocks 0 to 2 are of the same column, but data of the print data signal used in the block 3 is (N−1)3 in the previous column (N−1). Further, in FIG. 9C, though data N1 to N3 of the print data signal used in the blocks 1 to 3 are of the same column, data of the print data signal used in the block 0 is (N+1)0 in the subsequent column (N+1).

Note that in the printhead used in the above-described embodiment, as two nozzle arrays are assembled within one module, the amount of mechanical registration shift can be within a ±½ dot pitch.

In accordance with the above-described embodiment, the registration shift correction by electrical control can correct the amount of registration shift to substantially 0.

However, in printers having a construction where a couple of independent printheads are arrayed in a main-scanning direction, generally, the amount of registration shift is a 1 dot pitch or greater. In this case, it may be arranged such that registration shift correction is performed in dot pitch units by shift-transferring a print data signal by the number of columns corresponding to the amount of registration shift, as in the conventional art, then, the above-described registration shift correction by electrical control is applied to sub-dot pitch correction.

Figure 11:
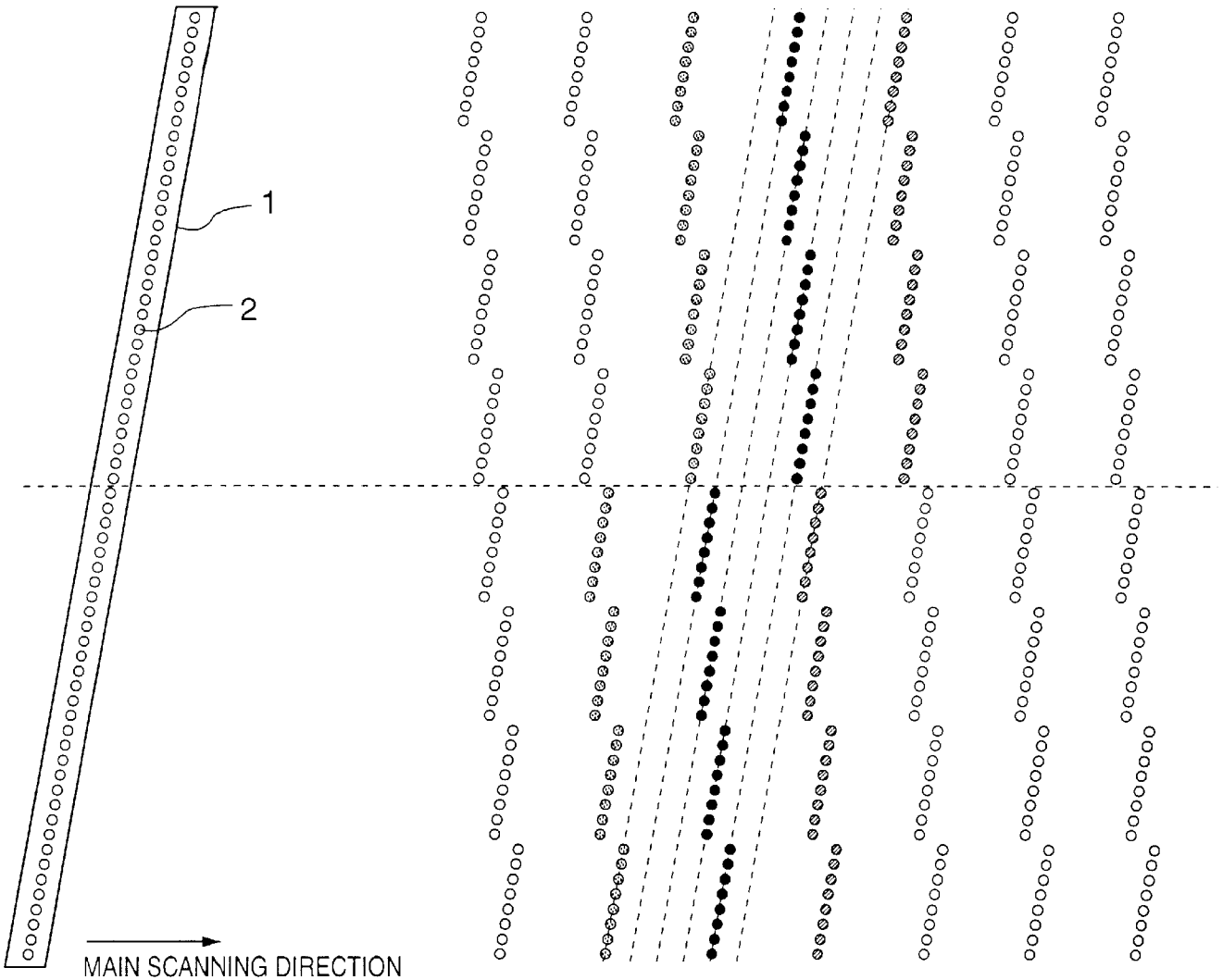
FIG. 11 is an explanatory diagram of a nozzle arrangement surface of a printhead having a single long nozzle array (with a large number of nozzles)

Note that in the above-described embodiment, the printhead has two nozzle arrays, however, the present invention is not limited to this arrangement. For example, the present invention is applicable to a printhead having a single long nozzle array (the number of nozzles is large) 1 as shown in FIG. 11.

Figure 12:
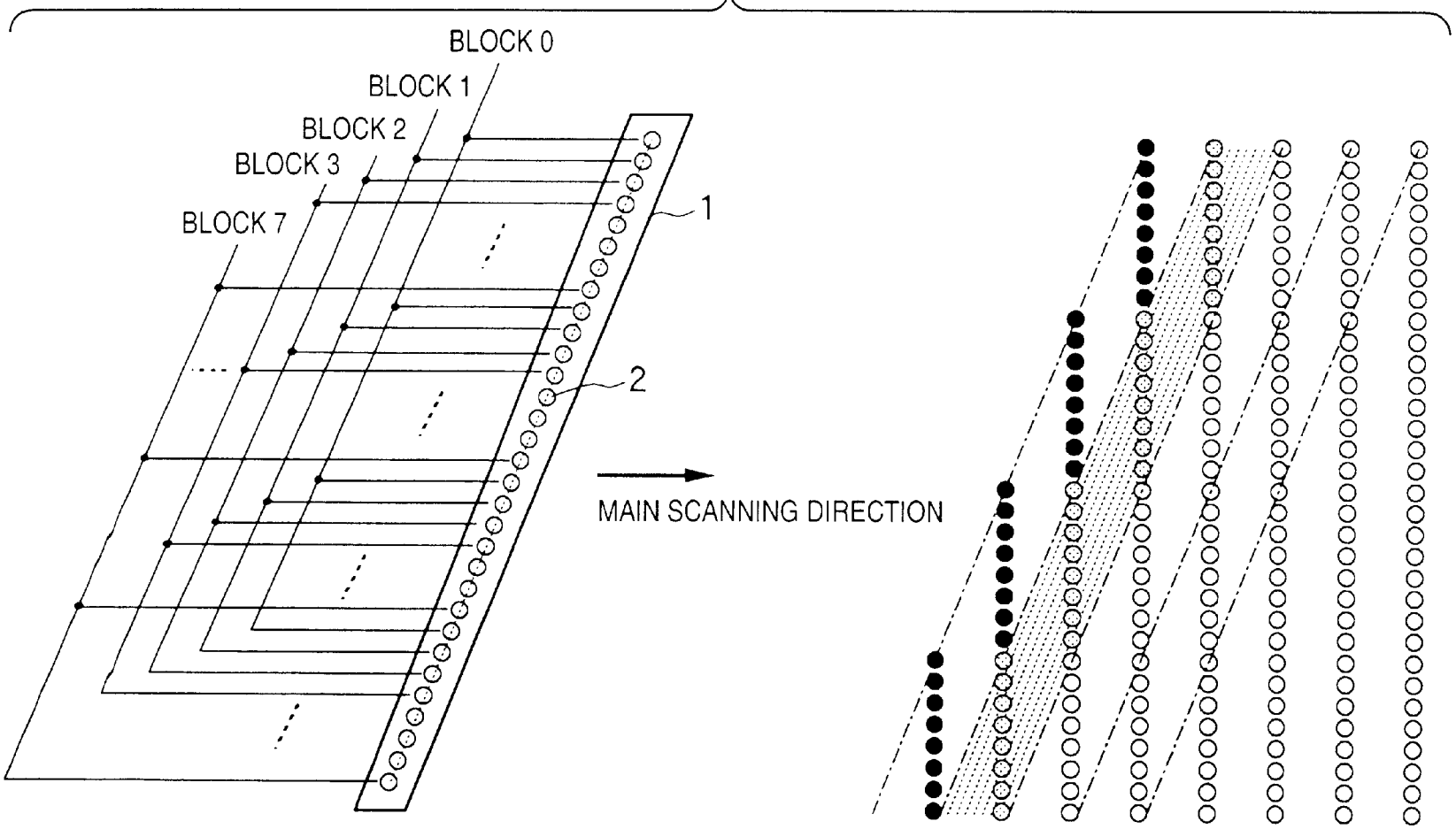
FIG. 12 is an explanatory diagram showing dots printed by 32 nozzles divided into 8 blocks each having 4 nozzles each selected from every 8 nozzles and time-divisionally driven in block units.

Further, in the above-described embodiment, 32 nozzles constructing one nozzle array are sequentially divided into 4 blocks by 8 nozzles, and the nozzles are time-divisionally driven in block units, however, the present invention is not limited to this arrangement. For example, it may be arranged such that the 32 nozzles are divided into 8 blocks each having 4 nozzles, each selected from every 8 nozzles, as shown in FIG. 12, and the respective blocks are sequentially driven. That is, time-division driving may be performed such that 4 nozzles each selected from every 8 nozzles are simultaneously driven.

In this case, also considering the fact that the arrangement of printed dots becomes slant when the nozzle array is vertical to the main-scanning direction, upon execution of printing operation while moving the printhead in the arrow direction (main-scanning direction), similar to that in the printhead IJH in FIG. 4, the printhead is slanted with respect to the main-scanning direction in advance, so that the arrangement of printed dots can be vertical to the main-scanning direction.

In the printhead that performs this time-division driving, dot shift in each junction between nozzle blocks as shown in FIG. 4 does not occur. However, a vertical line is not printed in one printing operation but it is printed at driving timings in different columns for the respective groups having 8 nozzles as shown in FIG. 12.

Figure 13A:
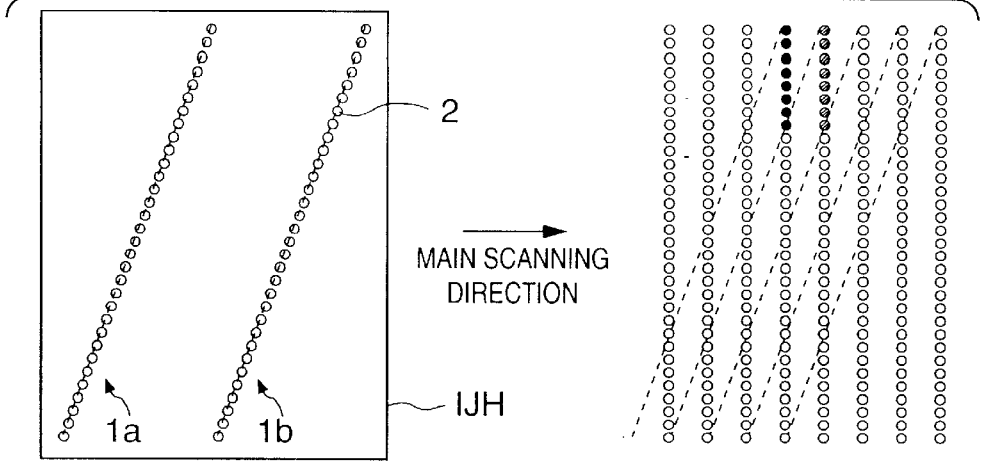
FIGS. 13A to 13C are explanatory diagrams of dot arrangements in registration adjustment by shifting the positions of dots printed by a printhead which performs time-division driving in FIG. 12.
Figure 13B:
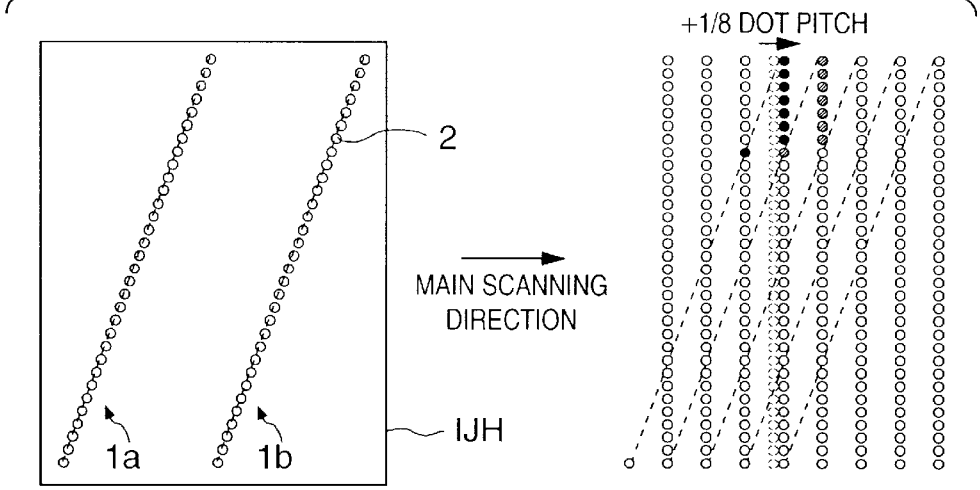
Figure 13C:
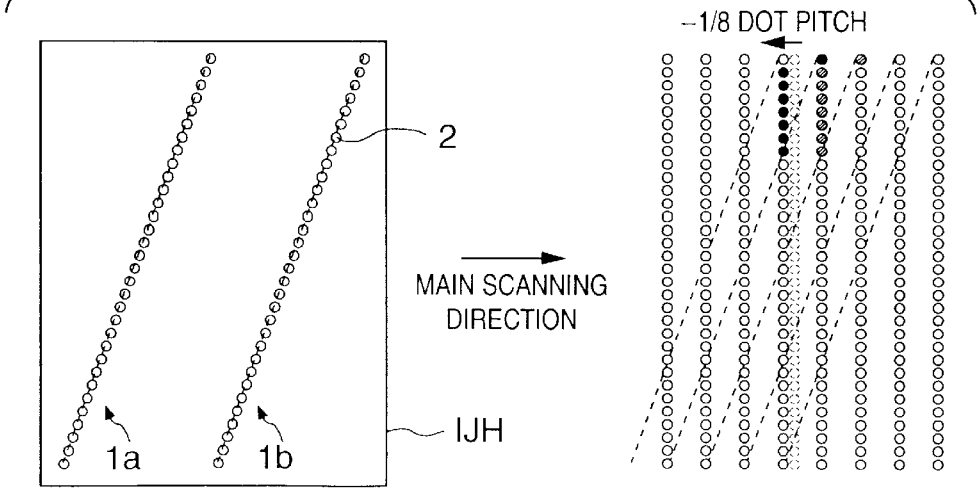

FIGS. 13A to 13C show dot arrangements in registration adjustment by shifting the positions of dots printed by the printhead which performs the time-division driving in FIG. 12. FIG. 13A shows the dot arrangement where shift amount=0 holds; FIG. 13B, the dot arrangement where shift amount=+⅛ dot pitch holds; and FIG. 13C, the dot arrangement where shift amount=−⅛ dot pitch holds, as those in FIGS. 9A to 9C.

In FIGS. 13A to 13C, the order of the groups to be driven in FIG. 13A is group 0→group 1→group 2→group 3→group 4→group 5→group 6→group 7→ . . . ; in FIG. 13B, the order of groups is group 7→group 0→group 1→group 2→group 3→group 4→group 5→group 6→ . . . ; and in FIG. 13C, the order of groups is group 1→group 2→group 3→group 4→group 5→group 6→group 7→group 0→ . . .

On the other hand, regarding correction by print data signal shift, it may be arranged such that the print data signal shift is corrected in the printer and the shifted data is transmitted to the printhead, and the shift correction may be realized by a printer driver of a host which transfers data to the printer. However, as in the above-described embodiment, in a case where a function to shift print data signal is provided in the logic circuit in the printhead, even though the print data signal shift is not corrected in the printer or the host, it is possible for the printhead to perform the correction. Thus, this type of printhead is particularly advantageous if the printhead is exchangeably used in the same printer.

Further, in the above-described embodiment, the block driving signal is common to all the nozzle arrays, however, it may be arranged such that the change of the order of blocks to be driven is realized by the printer and different signals are sent to the respective nozzles.

Further, in the above-described embodiment, the printhead has 2 nozzle arrays for the sake of simplicity of explanation. However, the present invention is applicable to, for example, a printhead having four nozzle arrays arranged in a carriage moving direction, or a construction where 4 printheads are arrayed in a carriage moving direction. In these cases, color printing can be realized by discharging cyan, magenta, yellow and black ink from the 4 nozzle arrays or printheads. By application of the present invention to these cases, fine registration adjustment can be performed on dots printed by 4 color ink. Thus, high quality color images with excellent color reproduction can be printed.

In addition, the present invention can be applied to a case where more nozzle arrays or printheads are provided to discharge ink in the same color tone but in different densities. In such case, high quality color images with excellent tonality representation can be printed.

The above-described embodiments describe a case where a printhead has two nozzle arrays (two print element arrays). However, this invention is not limited to this. It goes without saying that the printhead may have a construction having a single nozzle (print element) array.

This present invention is particularly advantageous if the invention is applied to a case where a relative positional relation among a plurality of nozzle (printing element) arrays is adjusted.

Note that in the above embodiments, the liquid discharged from the printhead has been described as ink, and the liquid contained in the ink tank has been described as ink.

However, the liquid is not limited to ink. For example, the ink tank may contain processed liquid or the like discharged to a print medium to improve fixability or water repellency of a printed image or to increase the image quality.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main body and can receive an ink from the apparatus main body upon being mounted on the apparatus main body can be employed as well as a cartridge type printhead in which an ink tank is integrally arranged on the printhead itself as described in the above embodiment.

It is preferable to add recovery means for the printhead, preliminary auxiliary means and the like to the above-described construction of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the printing apparatus of the present invention may be used in the form of a copying machine combined with a reader and the like, or a facsimile apparatus having a transmission/reception function in addition to an image output terminal of an information processing apparatus such as a computer.

The present invention can be applied to a system constituted by a plurality of devices (e.g., a host computer, an interface, a reader and a printer) or to an apparatus comprising a single device (e.g., a copy machine or a facsimile apparatus).

Further, it goes without saying that the invention is applicable also to a case where the object of the invention is attained by supplying a storage medium, containing software program code for realizing the aforesaid functions of the present embodiment, to a system or an apparatus, reading and executing the program code stored in the storage medium by a computer (e.g., CPU, MPU) of the system or apparatus.

In this case, the program code read from the storage medium realizes the functions according to the embodiment, and the storage medium containing the program code constitutes the invention.

Further, the storage medium, such as a floppy disk, a hard disk, an optical disk, a magneto-optical disk, CD-ROM, CD-R, a magnetic tape, a non-volatile type memory card, and a ROM can be used for providing the program code.

Furthermore, besides aforesaid functions according to the above embodiment are realized by executing the program code which are read by a computer, the present invention includes a case where an OS (operating system) or the like working on the computer performs a part or entire processes in accordance with designations of the program code and realizes functions according to the above embodiment.

Furthermore, the present invention also includes a case where, after the program code read from the storage medium are written in a function expansion board which is inserted into the computer or in a memory provided in a function expansion unit which is connected to the computer, CPU or the like contained in the function expansion card or unit performs a part or entire process in accordance with designations of the program code and realizes functions of the above embodiment.

As many apparently widely different embodiments of the present invention can be made without departing from the spirit and scope thereof, it is to be understood that the invention is not limited to the specific embodiments thereof except as defined in the appended claims.

What is claimed is:

1. A printhead capable of printing by dividing a plurality of printing elements constituting a printing element array into a plurality of blocks and time-divisionally driving said plurality of printing elements in block units, comprising:

a memory circuit for storing a value based on an amount of registration shift equal to or less than a printing resolution in a direction in which the printing element array is scanned relative to a printing medium; and a changing circuit that changes an order of blocks to be driven in accordance with the value stored in said memory circuit.

2. The printhead according to claim 1, wherein a number of the printing element array is plural, said plurality of printing element arrays are arranged at an interval along the direction, and said changing circuit changes the order of blocks to be driven in at least one of said plurality of printing element arrays.

3. The printhead according to claim 2, wherein said plurality of printing element array includes a first and second printing element arrays.

4. The printhead according to claim 3, wherein division of said plurality of printing elements into blocks is made by dividing said plurality of printing elements of said first and second printing element arrays into blocks by N printing elements sequentially.

5. The printhead according to claim 3, wherein division of said plurality of printing elements into blocks is made by dividing said plurality of printing elements of said first and second printing element arrays into blocks by K printing elements each selected from every M printing elements.

6. The printhead according to claim 3, wherein the direction of said plurality of printing elements of said first and second printing element arrays is diagonal to the direction.

7. The printhead according to claim 3, further comprising third and fourth printing element arrays in said first direction in parallel to said first and second printing element arrays, wherein color printing is performed by discharging yellow ink, magenta ink, cyan ink and black ink from said first, second, third and fourth printing element arrays.

8. The printhead according to claim 1, wherein said plurality of printing elements are divided into four, eight, sixteen or thirty two blocks.

9. The printhead according to claim 1, further comprising a delay circuit that delays print data output to printing elements of each block of said printing element array in accordance with change of the order of blocks to be driven by said changing circuit.

10. The printhead according to claim 1, wherein said printhead is an ink-jet printhead that performs printing by discharging ink.

11. The printhead according to claim 10, wherein said ink-jet printhead has electrothermal transducers for generating thermal energy to be supplied to ink, for discharging the ink by utilizing the thermal energy.

12. The printhead according to any one of claims 3 to 10 wherein said first and second printing element arrays are respectively assembled in separate printheads.

13. A printing apparatus which performs printing by using the printhead according to any one of claims 1 to 7, comprising:

scanning means, carrying said printhead, for reciprocate-scanning said printhead along the direction; and output means for outputting print data to said printhead.

14. A printing apparatus which performs printing by dividing a plurality of printing elements constituting a printing element array into a plurality of blocks and time-divisionally driving said plurality of printing elements in block units, comprising:

a memory circuit for storing a value based on an amount of registration shift equal to or less than a printing resolution in a direction in which said printing element array is scanned relative to a printing medium; and a changing circuit that changes an order of blocks to be driven in accordance with the value stored in said memory circuit.

15. The printing apparatus according to claim 14, further comprising a delay circuit that delays print data output to printing elements of each block of said printing element array in accordance with change of the order of blocks to be driven by said changing circuit.

* * * * *

UNITED STATES PATENT AND TRADEMARK OFFICE

CERTIFICATE OF CORRECTION

PATENT NO. : 6,371,588 B1
DATED : April 16, 2002
INVENTOR(S) : Yuji Tsuruoka

It is certified that error appears in the above-identified patent and that said Letters Patent is hereby corrected as shown below:

Title page,
Item [56], References Cited,
U.S. PATENT DOCUMENTS, “Mwrata” should read -- Murata --.
FOREIGN PATENT DOCUMENTS, “JP 59-138461 8/1994” should read -- JP 59-138461 8/1984 --.

Column 5,
Line 51, "slant" should read -- slanted --; and
Line 53, "are" should read -- is --.

Column 6,
Line 9, "block" should read -- blocks --; and
Line 35, "perform" should read -- performs --.

Column 7,
Line 7, ""3" . . ." should read -- "3" →. . . --; and
Line 10, ". . ." should read -- . . . . --.

Column 9,
Line 14, "(N)," should read -- (N); --;
Line 41, "arrays," should read -- arrays; --;
Line 44, "1" should read -- 1 --;
Line 49, "units," should read -- units; --; and
Line 58, "slant" should read -- slanted --.

Column 10,
Line 35, "arrays," should read -- arrays; --.

UNITED STATES PATENT AND TRADEMARK OFFICE

CERTIFICATE OF CORRECTION

PATENT NO. : 6,371,588 B1 
DATED : April 16, 2002
INVENTOR(S) : Yuji Tsuruoka

It is certified that error appears in the above-identified patent and that said Letters Patent is hereby corrected as shown below:

Column 13,
Line 14, "are" should read -- is --; and
Line 16, "CPU" should read -- a CPU --.

Column 14,
Line 14, "thirty two" should read -- thirty-two --; and
Line 32, "1 to 7" should read -- 1 to 11 --.

Signed and Sealed this

Twenty-fourth Day of December, 2002

JAMES E. ROGAN
*Director of the United States Patent and Trademark Office*